US007923915B2

(12) United States Patent
Li et al.

(10) Patent No.: US 7,923,915 B2
(45) Date of Patent: Apr. 12, 2011

(54) DISPLAY PIXEL STRUCTURE AND DISPLAY APPARATUS

(75) Inventors: Jung-Yu Li, Yonghe (TW); Shih-Pu Chen, Hsinchu (TW); Yi-Ping Lin, Lugang Township, Changhua County (TW); Wei-Chih Lin, Sanchong (TW); Lian-Yi Cho, Jhunan Township, Miaoli County (TW)

(73) Assignee: Industrial Technology Research Institute, Hsinchu (TW)

( * ) Notice: Subject to any disclaimer, the term of this patent is extended or adjusted under 35 U.S.C. 154(b) by 353 days.

(21) Appl. No.: 11/958,393

(22) Filed: Dec. 18, 2007

(65) Prior Publication Data

US 2008/0157652 A1 Jul. 3, 2008

Related U.S. Application Data

(63) Continuation-in-part of application No. 11/674,159, filed on Feb. 13, 2007, now abandoned.

(30) Foreign Application Priority Data

Dec. 18, 2006 (TW) ..... 95147427 A
Aug. 3, 2007 (TW) ..... 96128668 A

(51) Int. Cl.
*H01J 63/04* (2006.01)

(52) U.S. Cl. ..... 313/496

(58) Field of Classification Search ..... 313/582–586; 345/60–67

See application file for complete search history.

(56) References Cited

U.S. PATENT DOCUMENTS

| | | | | |
|---|---|---|---|---|
| 6,629,869 | B1 | 10/2003 | Kumar et al. | |
| 2003/0001492 | A1 | 1/2003 | Pei et al. | |
| 2003/0178934 | A1 * | 9/2003 | Jeong et al. | 313/495 |
| 2006/0158454 | A1 * | 7/2006 | Heynderickx et al. | 345/589 |

FOREIGN PATENT DOCUMENTS

| | | |
|---|---|---|
| CN | 1111783 | 11/1995 |
| CN | 1480977 | 3/2004 |

(Continued)

OTHER PUBLICATIONS

"1st Office Action of China counterpart application", issued on May 8, 2009, p. 1-p. 7.

(Continued)

*Primary Examiner* — Joseph L Williams
*Assistant Examiner* — Brenitra M Lee
(74) *Attorney, Agent, or Firm* — Jianq Chyun IP Office

(57) ABSTRACT

A pixel structure of display apparatus includes a first substrate and a second substrate. Several cathode structure layers are disposed on the first substrate. The second substrate is a light-transmissive material. Several anode structure layers are disposed on the second substrate, and are light-transmissive conductive materials. The first substrate faces to the second substrate, so that the cathode structure layers are respectively aligned with the anode structure layers. A separation structure is disposed between the first substrate and the second substrate, for respective partitioning the anode structure layers and the cathode structure layers to form several spaces. Several fluorescent layers are respectively disposed between the anode structure layers and the cathode structure layers. A low-pressure gas is respectively filled into the spaces. The low-pressure gas has an electron mean free path, allowing at least sufficient amount of electrons to directly impinge the fluorescent layer under an operation voltage.

36 Claims, 11 Drawing Sheets

FOREIGN PATENT DOCUMENTS

| | | |
|---|---|---|
| CN | 1618113 | 5/2005 |
| CN | 1794399 | 6/2006 |
| CN | 1875665 | 12/2006 |
| EP | 1628325 | 2/2006 |
| EP | 1684321 | 7/2006 |
| EP | 1691585 | 8/2006 |
| JP | 05-047297 | 2/1993 |
| JP | 08-031303 | 2/1996 |
| JP | 09-179106 | 7/1997 |
| JP | 10-116555 | 5/1998 |
| JP | 2004-146364 | 5/2004 |
| JP | 2005-216704 | 8/2005 |
| JP | 2005-310647 | 11/2005 |
| JP | 2006-164938 | 6/2006 |
| KR | 1998-80595 | 11/1998 |
| KR | 1020040011856 | 2/2004 |
| WO | 03-054902 | 7/2003 |

OTHER PUBLICATIONS

"2nd Office Action of China counterpart application", issued on Sep. 11, 2009, p. 1-p. 8.

"1st Office Action of Chinese counterpart application", issued on Jun. 26, 2009, p. 1-p. 7.

Yuan Cheng & Otto Zhou, Electron field emission from carbon nanotubes, C. R. Physique 4(2003) 1021-1033.

"Office Action of Japan Counterpart Application", issued on Jan. 11, 2011, pp. 1-3, in which the listed references were cited.

* cited by examiner

DISPLAY PIXEL STRUCTURE AND DISPLAY APPARATUS

CROSS-REFERENCE TO RELATED APPLICATION

This application is a continuation-in-part of a prior U.S. application Ser. No. 11/674,159, filed on Feb. 13, 2007, and also claims the priority benefit of Taiwan application serial no. 96128668, filed on Aug. 3, 2007. The U.S. application Ser. No. 11/674,159 claims the priority benefit of Taiwan application serial no. 95147427, filed on Dec. 18, 2006. The entirety of each of the above-mentioned patent applications is incorporated herein by reference and made a part of this specification.

BACKGROUND OF THE INVENTION

1. Field of the Invention

The present invention generally relates to a light-emitting device, in particular, to an electron emission light-emitting device and applications thereof.

2. Description of Related Art

Currently, mass-produced light source apparatus or display apparatus mainly employ two types of light-emitting structures, which are described as follows.

1. Gas-discharge light sources: the gas-discharge light sources are applicable to, for example, plasma panels or gas-discharge lamps, for ionizing the gas filled in a discharge chamber by the use of an electric field between a cathode and an anode, such that electrons impinge the gas by means of glow discharge to generate transition and emit ultraviolet (UV) lights. And, a fluorescent layer located in the same discharge chamber absorbs the UV lights to emit visible lights.
2. Field emission light source: the field emission light source are applicable to, for example, carbon nanotube field emission display, for providing an ultra high vacuum environment, and an electron emitter made of a carbon nanomaterial is fabricated on a cathode, so as to help the electrons to overcome the work function of the cathode to depart from the cathode by the use of the microstructure of high aspect ratio in the electron emitter. Moreover, a fluorescent layer is coated on an anode made of indium tin oxide (ITO), such that the electrons escape from the carbon nanotube of the cathode due to a high electric field between the cathode and the anode. Therefore, the electrons impinge the fluorescent layer on the anode in the vacuum environment, so as to emit visible lights.

However, the above two types of light-emitting structures have disadvantages. For example, the attenuation occurs after the irradiation of the UV lights, so that specific requirements must be taken into account in selecting the material in the gas-discharge light source. Moreover, the gas-discharge light-emitting mechanism emits the visible lights through two processes, so that more energy is consumed, and if the plasma must be generated in the process, more electricity is consumed. On the other hand, the field emission light source requires a uniform electron emitter to be grown or coated on the cathode, but the mass production technique of this type of cathode structure is not mature, and the uniformity and a poor production yield of the electron emitter are still bottlenecks. Further, a distance between the cathode and the anode of the field emission light source must be accurately controlled, and the ultra high vacuum packaging is quite difficult and also increases the fabrication cost.

SUMMARY OF THE INVENTION

Accordingly, the present invention is directed to a display pixel structure having good light-emitting efficiency and easy to fabricate, which is constituted by an electron emission light-emitting device.

The present invention is further directed to a display apparatus, which uses the electron emission light-emitting device to serve as the display pixel, so as to provide a good display quality, and to reduce cost and complexity in fabrication.

As embodied and broadly described herein, a pixel structure of a display apparatus is provided, which includes a first substrate and a second substrate. A plurality of cathode structure layers is disposed on the first substrate. The second substrate is made of a light-transmissive material. A plurality of anode structure layers is disposed on the second substrate, and the anode structure is made of a light-transmissive conductive material. The first substrate faces to the second substrate, such that the cathode structure layers are respectively aligned with the anode structure layers. A separation structure is disposed between the first substrate and the second substrate, for respectively partitioning the anode structure layers and the cathode structure layers to form a plurality of spaces. A plurality of fluorescent layers is respectively disposed between the anode structure layers and the cathode structure layers. A low-pressure gas is filled in the spaces. The low-pressure gas layer has an electron mean free path, allowing at least sufficient amount of electrons to directly impinge the fluorescent layers under an operation voltage.

Further, the present invention further provides a display apparatus including a plurality of display pixels arranged in an array. Each display pixel includes an electron emission light-emitting device. The electron emission light-emitting device includes a cathode structure layer; an anode structure layer; a fluorescent layer disposed between the cathode structure layer and the anode structure layer; and a low-pressure gas disposed between the cathode and the anode, for inducing the cathode to emit a plurality of electrons uniformly. The low-pressure gas has an electron mean free path, allowing at least sufficient amount of electrons to directly impinge the fluorescent layer under an operation voltage.

The present invention further provides a display apparatus, which includes a first substrate and a second substrate. A plurality of cathode structure layers is disposed on the first substrate, so as to form a two-dimensional array. The second substrate is made of a light-transmissive material. A plurality of anode structure layers is disposed on the second substrate, and the anode structure layer is made of a light-transmissive conductive material. The first substrate faces to the second substrate, such that the cathode structure layers are respectively aligned with the anode structure layers. A separation structure is disposed between the first substrate and the second substrate, for respectively partitioning the anode structure layers and the cathode structure layers to a plurality of spaces. A plurality of fluorescent layers is respectively disposed between the anode structure layers and the cathode structure layers. A low-pressure gas is filled in the spaces, and the low-pressure gas layer has an electron mean free path, allowing at least sufficient amount of electrons to directly impinge the fluorescent layer under an operation voltage. A plurality of drive units is disposed on at least one of the first substrate and the second substrate, for controlling the pixels of the two-dimensional array, so as to apply the corresponding operation voltage to generate luminance gray-levels.

In view of the above, the present invention uses a thin gas to easily induce electrons from the cathode, thus avoiding possible problems resulting from fabricating the electron emitter on the cathode. Moreover, as the gas is thin, the electrons have a large mean free path allowing most electrons to directly react with the fluorescent layer to emit light before colliding the gas, and this process does not cause the glow discharge. In other words, the electron emission light-emitting device of the present invention has a higher light emitting efficiency, is easy to fabricate, and has a better production yield.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
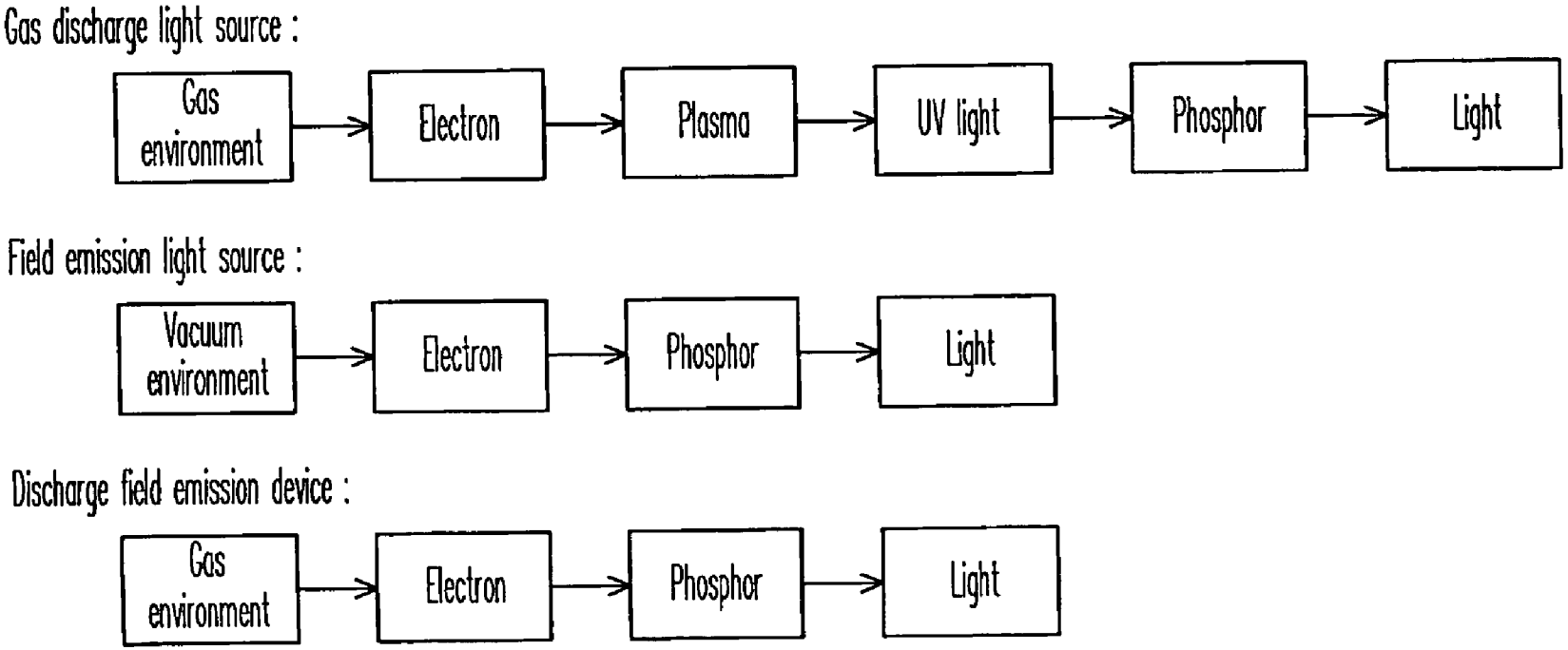
FIG. 1 is a schematic view illustrating a comparison between the light-emitting mechanisms of a conventional light-emitting structure and an electron emission light-emitting device of the present invention.

Reference will now be made in detail to the present embodiments of the invention, examples of which are illustrated in the accompanying drawings. Wherever possible, the same reference numbers are used in the drawings and the description to refer to the same or like parts.

The electron emission light-emitting device provided by the present invention has the advantages of the conventional gas-discharge light source and field emission light source, and overcomes the disadvantages of the above two conventional light-emitting structures. Referring to FIG. 1, a schematic view illustrating a comparison between light-emitting mechanisms of two conventional light-emitting structures and the electron emission light-emitting device of the present invention is shown. In detail, the conventional gas glow discharge light source utilizes an electric field between the cathode and the anode to ionize the gas filled in a discharge chamber, such that the electrons impinge other gas molecules by means of gas conduction so as to generate the UV lights, and a fluorescent layer absorbs the UV lights to generate the visible lights. Moreover, the conventional field emission light source helps the electrons to overcome the work function of the cathode to apart from the cathode in an ultra high vacuum environment by the use of the high aspect ratio structure of the electron emitter on the cathode. Thereafter, the electrons escape from the electron emitter of the cathode due to the high electric field between the cathode and the anode, and impinge the fluorescent layer on the anode, so as to emit the visible lights. In other words, the material of the fluorescent layer may be a material capable of emitting visible lights, infrared lights, or UV lights, depending on the requirements of design mechanism.

Different from the above two conventional light-emitting mechanisms, the electron emission light-emitting device of the present invention uses a thin gas instead of the electron emitter to easily induce the electrons from the cathode, such that the electrons directly react with the fluorescent layer to emit light rays.

Comparing with the conventional gas glow discharge light source, the amount of the gas filled in the electron emission light-emitting device of the present invention is only required to be enough for inducing the electrons from the cathode and do not generate the glow discharge, while light rays are not generated by using UV lights to irradiate the fluorescent layer. Therefore, the attenuation of the material in the device caused by the irradiation of the UV lights will not occur. Experiments and theories verify that that the gas in the electron emission light-emitting device of the present invention is thin, and thus the mean free path of the electrons can be up to about 5 mm or above. In other words, most electrons directly impinge the fluorescent layer to emit light rays before impinging the gas molecules. Moreover, the electron emission light-emitting device of the present invention does not need to generate light rays through two processes, thus having higher light emitting efficiency and reducing the power consumption.

On the other hand, the conventional field emission light source requires forming the microstructure serving as the electron emitter on the cathode, and the microstructure is difficult to control in mass production process. The most common microstructure is carbon nanotube, but when coated on the cathode, problems of different tube lengths and gathering into clusters are generated, and thus a light emitting surface has dark spots and the light emission uniformity is unsatisfactory, which are the technical bottlenecks and main costs of the field emission light source. The electron emission light-emitting device of the present invention is capable of inducing the electrons uniformly from the cathode by the use of gas, and only a simple cathode planar structure is used to achieve 75% light emission uniformity for an electron emission light-emitting panel, thus solving the bottleneck of the conventional field emission light-emitting apparatus that the light emission uniformity is difficult to improve. Therefore, the fabrication cost can be significantly saved, and the process is simpler. Moreover, the electron emission light-emitting device of the present invention is filled with the thin gas, so the ultra high vacuum environment is not required, thus avoiding the difficulties encountered during the ultra high vacuum packaging. Furthermore, the experiment results show that the electron emission light-emitting device of the present invention can reduce a turn on voltage to about 0.4 V/μm with the help of the gas, which is much lower than the turn on voltage of up to 1-3 V/μm of the common field emission light source.

Further, based on the Child-Langmuir equation, after substituting the practical relevant data of the electron emission light-emitting device of the present invention into the equation, it can be calculated that the distribution of a dark region of the cathode of the electron emission light-emitting device of the present invention ranges from about 10 cm to 25 cm, which is much greater than the distance between the anode and the cathode. In other words, the electron emission light-emitting device of the present invention uses the gas to induce the electrons of the cathode, and the electrons directly react with the fluorescent layer to emit lights.

Figure 2:
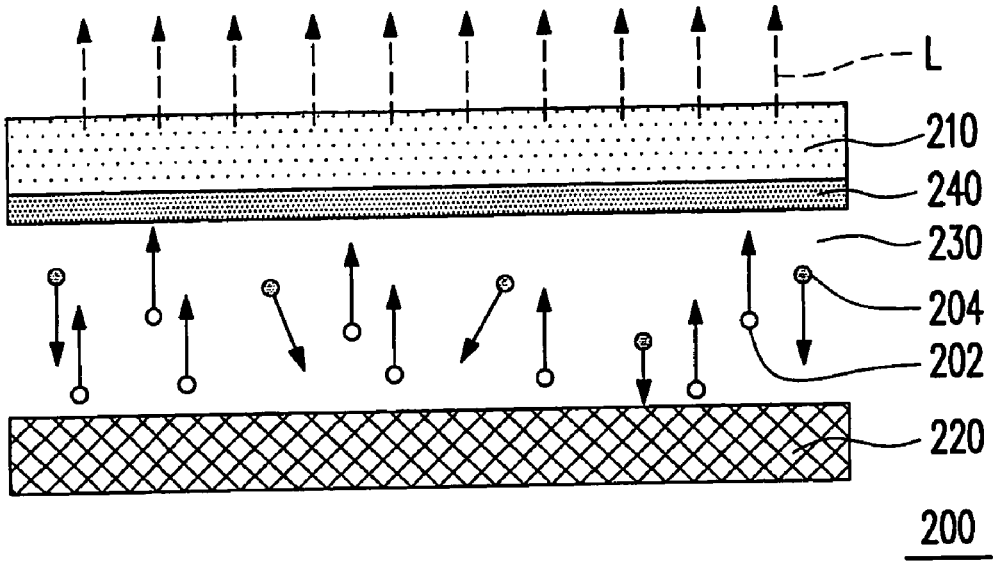
FIG. 2 schematically shows a basic architecture of the electron emission light-emitting device of the present invention.

FIG. 2 shows a basic architecture of the electron emission light-emitting device of the present invention. Referring to FIG. 2, the electron emission light-emitting device 200 mainly includes an anode 210, a cathode 220, a gas 230, and a fluorescent layer 240. The gas 230 is located between the anode 210 and the cathode 220, and the gas 230 generates proper amount of positive ions 204 under an electric field, for inducing the cathode 220 to emit a plurality of electrons 202. It should be noted that an ambient gas pressure of the gas 230 of the present invention is between $8\times10^{-1}$ torr and $10^{-3}$ torr, and preferably between $2\times10^{-2}$ torr and $10^{-3}$ torr or between $2\times10^{-2}$ torr and $1.5\times10^{-1}$ torr. Moreover, the fluorescent layer 240 is disposed on a move path of the electrons 202, so as to react with the electrons 202 to emit lights L.

In this embodiment, the fluorescent layer 240 is, for example, coated on a surface of the anode 210. In addition, the anode 210 is, for example, made of a light-transmissive conductive oxide (TCO), such that the lights L pass through the anode 210 and emerge from the electron emission light-emitting device 200. The light-transmissive conductive oxide may be a common material, for example, selected from indium tin oxide (ITO), F-doped tin oxide (FTO), or indium zinc oxide (IZO). Definitely, in other embodiments, the anode 210 or the cathode 220 may also be made of a metal or other materials with good conductivity.

The gas 230 used in the present invention may be an inert gas such as $N_2$, He, Ne, Ar, Kr, Xe, or a gas such as $H_2$ and $CO_2$ having good conductivity after ionization, or a common gas such as $O_2$ and air. In addition, by selecting the type of the fluorescent layer 240, the electron emission light-emitting device 200 can emit different types of lights, such as visible lights, infrared lights, or UV lights.

Figure 3:
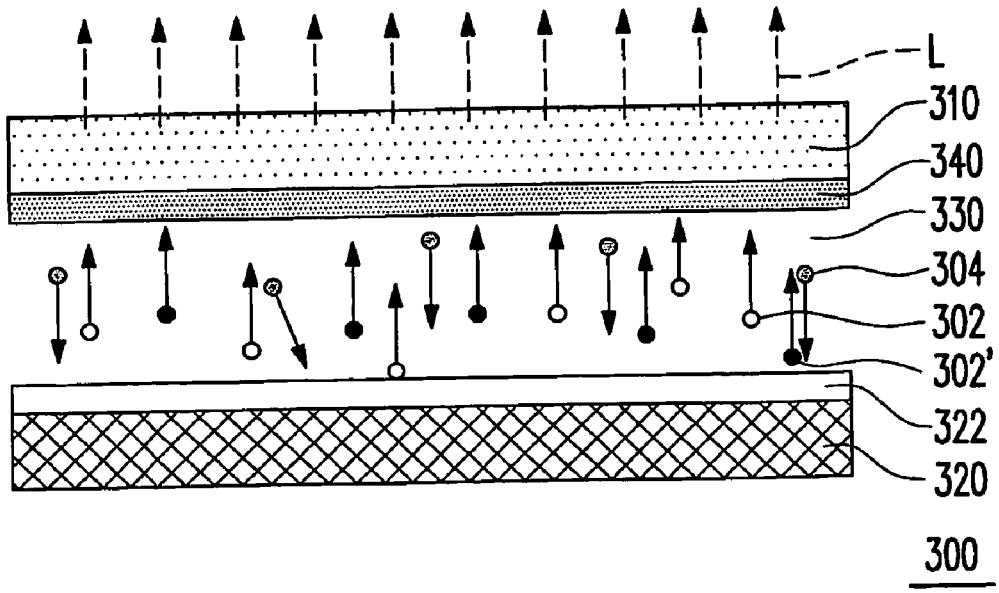
FIG. 3 schematically shows an electron emission light-emitting device according to another embodiment of the present invention.

In addition to the embodiment in FIG. 2, for improving the light emitting efficiency, the present invention further forms a material which is easy to generate the electrons on the cathode, so as to provide an additional electron source. In an electron emission light-emitting device 300 according to another embodiment of the present invention as shown in FIG. 3, a cathode 320 is, for example, formed with a secondary electron source material layer 322. The secondary electron source material layer 322 may be made of a material such as MgO, $Tb_2O_3$, $La_2O_3$, or $CeO_2$. The gas 330 generates ionized ions 304, and the ions 304 with positive charges move towards the cathode 320 away from the anode 310, so when the ions 304 impinge the secondary electron source material layer 322 on the cathode 320, additional secondary electrons 302' are generated. More electrons (including the original electrons 302 and the secondary electrons 302') react with the fluorescent layer 340 and generates more ionized ions 304, which helps to increase the light emitting efficiency and discharge stability. It should be noted that, the secondary electron source material layer 322 cannot only help to generate the secondary electrons, but also protect the cathode 320 from being over-bombarded by the ions 304.

Figure 4A:
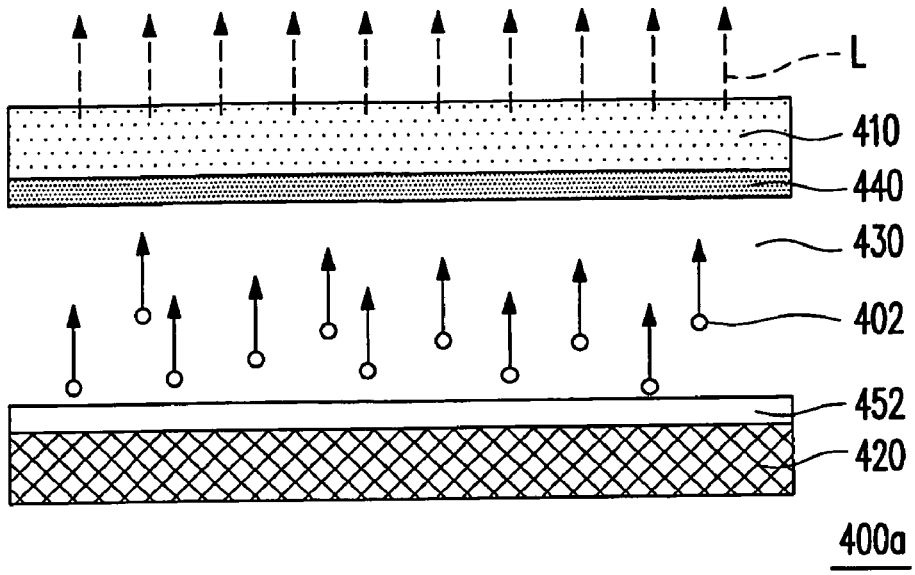
FIGS. 4A to 4C schematically show various electron emission light-emitting devices having induced discharge structures of the present invention.
Figure 4B:
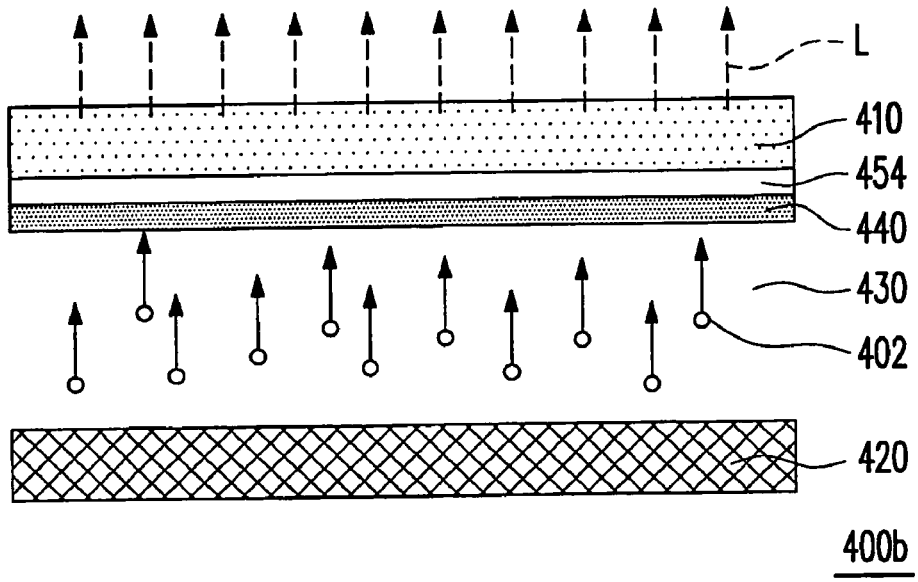
Figure 4C:
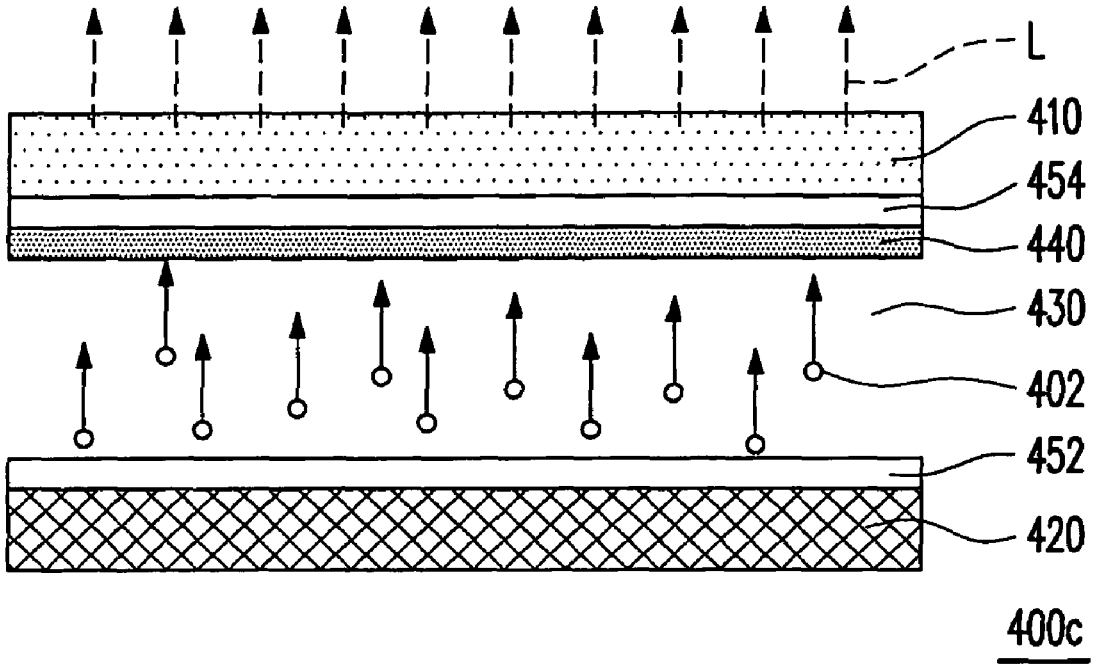

Further, the present invention can form a structure similar to the electron emitter of the field emission light source on the anode or the cathode or both, so as to reduce the working voltage on the electrode to generate electrons more easily. FIGS. 4A to 4C show various electron emission light-emitting devices having induced discharge structures of the present invention, in which like elements are indicated by the same numbers, and will not be described again below.

Referring to FIG. 4A, an induced discharge structure 452 is formed on a cathode 420 of an electron emission light-emitting device 400*a*, and the induced discharge structure 452 is, for example, a microstructure made of a material such as a metal material, a carbon nanotube, a carbon nanowall, a carbon nanoporous, a ZnO column, and ZnO. The induced discharge structure 452 may also be added with the aforementioned secondary electron source material layer. Moreover, a gas 430 is located between an anode 410 and the cathode 420, and a fluorescent layer 440 is disposed on a surface of the anode 410. A working voltage between the anode 410 and the cathode 420 may be reduced by the induced discharge structure 452, so as to generate electrons 402 more easily. The electrons 402 react with the fluorescent layer 440 to generate lights L.

An electron emission light-emitting device 400*b* in FIG. 4B is similar to that in FIG. 4A, and a distinct difference lies in that an induced discharge structure 454 is disposed on the anode 410, and as mentioned above, the induced discharge structure 454 may be a microstructure made of a material such as a metal material, a carbon nanotube, a carbon nanowall, a carbon nanoporous, a ZnO column, and ZnO. Also, the induced discharge structure 454 may also be added with the aforementioned secondary electron source material layer. In addition, the fluorescent layer 440 is disposed on the induced discharge structure 454.

FIG. 4C shows an electron emission light-emitting device 400*c* including the induced discharge structures 454 and 452, in which the induced discharge structure 454 is disposed on the anode 410, the fluorescent layer 440 is disposed on the induced discharge structure 454, and the induced discharge structure 452 is disposed on the cathode 420. The gas 430 is located between the anode 410 and the cathode 420.

The various electron emission light-emitting devices 400*a*, 400*b*, or 400*c* having the induced discharge structure(s) 452 and/or 454 may be integrated with the design of the secondary electron source material layer 322 as shown in FIG. 3, so as to form the secondary electron source material layer on the cathode 420. If the cathode 420 is formed with the induced discharge structure 454, the secondary electron source material layer then covers the induced discharge structure 454. Therefore, not only the working voltage between the anode 410 and the cathode 420 is reduced to generate the electrons 402 more easily, and the light emitting efficiency may also be improved by increasing the amount of the electrons 402 through the secondary electron source material layer.

Figure 5:
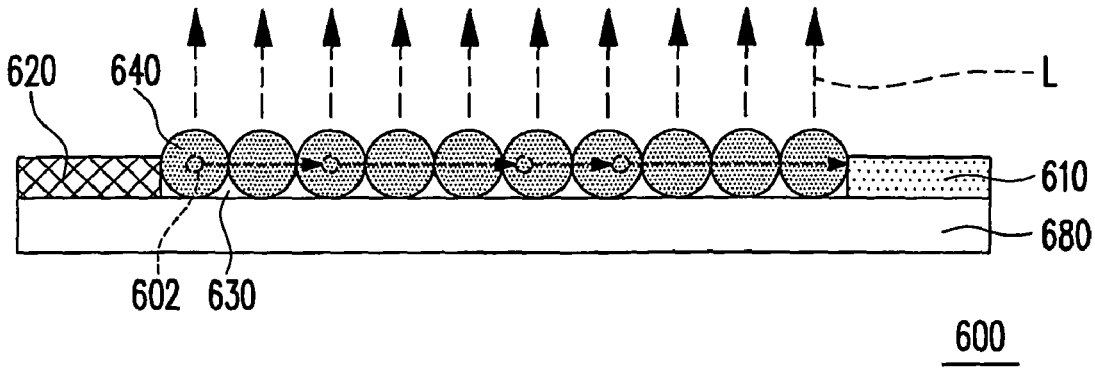
FIG. 5 schematically shows light-emitting structures of different shapes of the electron emission light-emitting device according to the present invention.
Figure 6:
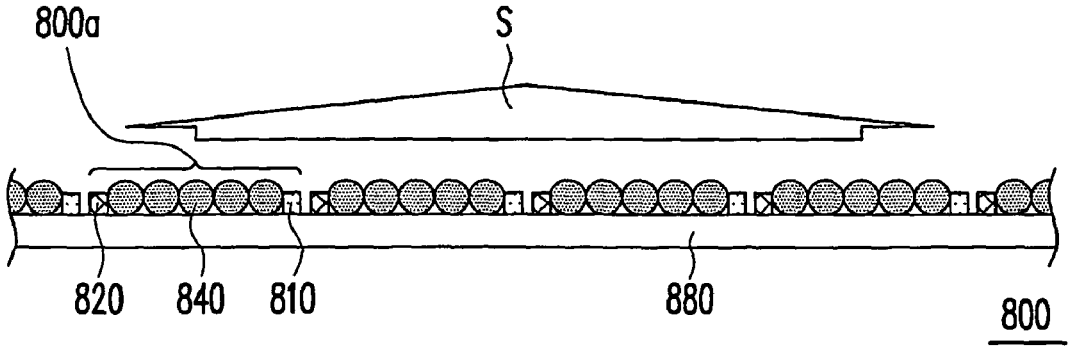
FIG. 6 schematically shows a light source apparatus according to an embodiment of the present invention.

The electron emission light-emitting devices serving as light-emitting structures provided by the present invention may have different forms. FIGS. 5 to 6 respectively show several light-emitting structures having different shapes using the electron emission light-emitting device according to the present invention.

FIG. 5 shows another in-plane emission type light emitting structure 600. An anode 610, a cathode 620, and a fluorescent layer 640 are disposed on a substrate 680. The substrate 680 is, for example, a glass substrate, and the material of the anode 610 and the cathode 620 is, for example, a metal, a common light-transmissive conductive oxide such as ITO or IZO, or other materials having good conductivity. The fluorescent layer 640 is located between the anode 610 and the cathode 620, and the electrons 602 induced by a gas 630 penetrate the fluorescent layer 640 to emit lights L. As mentioned above, an ambient gas pressure of the gas 630 is between $8\times10^{-1}$ torr and $10^{-3}$ torr, and preferably between $2\times10^{-2}$ torr and $10^{-3}$ torr or between $2\times10^{-2}$ torr and $1.5\times10^{-1}$ torr. The practical gas pressure and operation voltage change according to different distances between the cathode and anode, gas categories, and structures. In addition, the gas 630 used in the present invention can be an inert gas such as $N_2$, He, Ne, Ar, Kr, Xe, or a gas such as $H_2$ and $CO_2$ having good conductivity after ionization, or a common gas such as $O_2$ and air. In addition, by selecting the type of the fluorescent layer 640, the electron emission light-emitting device 600 can emit different types of lights, such as visible lights, infrared lights, or UV lights. The closed gas environment may be achieved through, for example, a common technology, and the details thereof will not be described herein.

The description of other devices is illustrated in the above embodiments and will not be described herein again.

It should be noted that the light-emitting structure of FIG. 5 is only described for illustration, instead of limiting the shape of the light-emitting structure in the present invention. In other embodiments, for example, the above light-emitting structure may be combined with the secondary electron source material layer 322 of FIG. 3 or the induced discharge structures 452 and 454 of FIGS. 4A to 4C depending on different considerations, so as to meet different requirements.

The electron emission light-emitting device of the present invention may be used to fabricate a light source apparatus, which is composed of, for example, any type of electron emission light-emitting device in the above several embodiments, so as to provide a light source. FIG. 6 shows a light source apparatus according to an embodiment of the present invention. Referring to FIG. 6, a light source apparatus 800 includes a plurality of electron emission light-emitting devices 800*a* arranged in an array, for providing a surface light source S. The design of the electron emission light-emitting device 800*a* selected in this embodiment includes, for example, any one of the above several embodiments. For example, the light source apparatus 800 can use a design similar to the light-emitting structure 600 of FIG. 6, and fabricate several sets of anodes 810, cathodes 820, and fluorescent layers 840 on a substrate 880, so as to achieve the large scale purpose.

Figure 7:
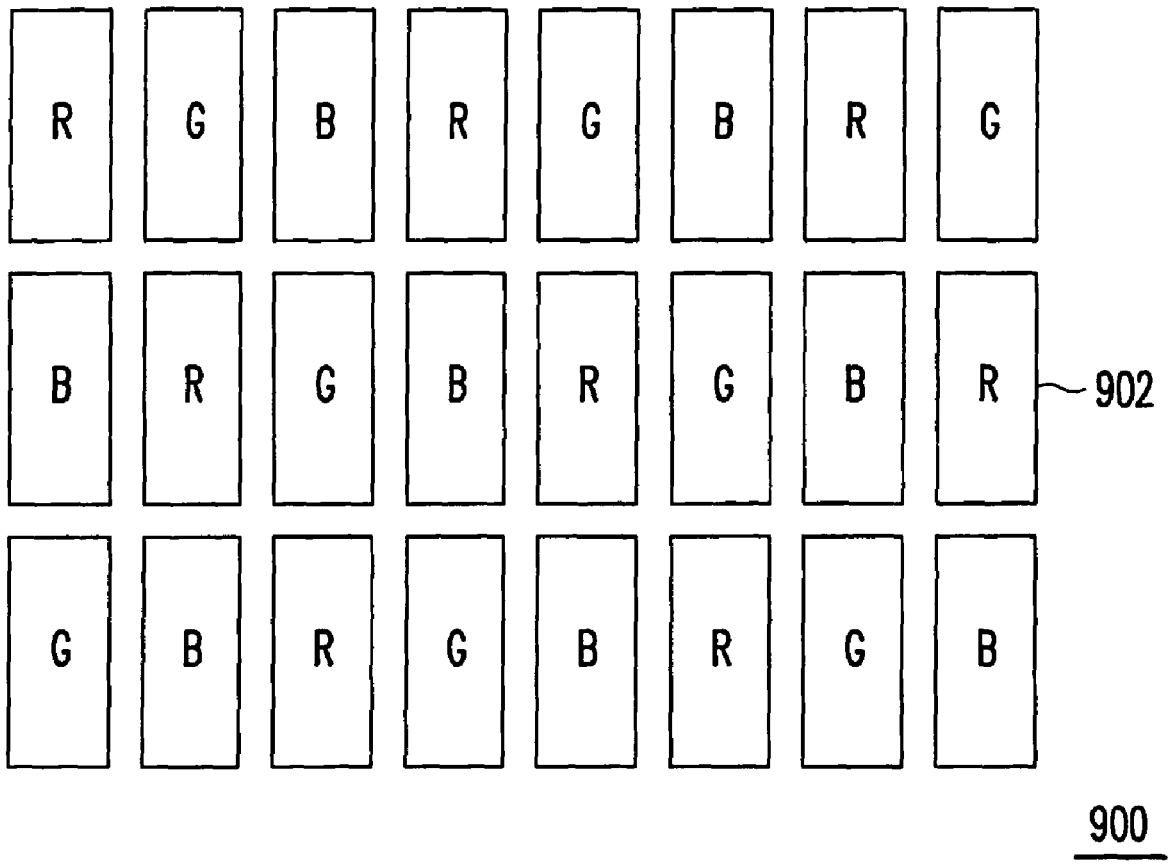
FIGS. 7 and 8 schematically show display apparatus according to embodiments of the present invention.
Figure 8:
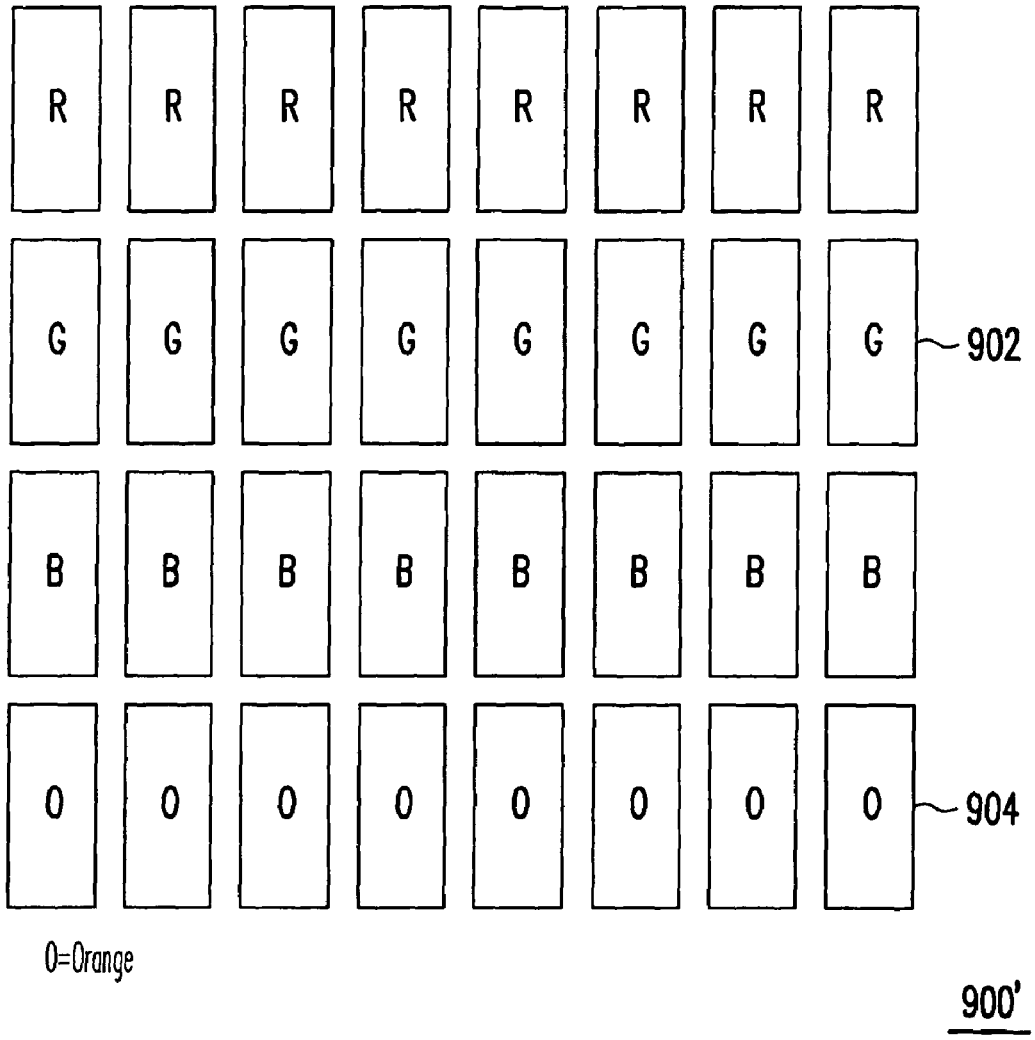

Definitely, various electron emission light-emitting devices mentioned above may also be applied in a display apparatus. FIG. 7 shows a display apparatus according to an embodiment of the present invention. Referring to FIG. 7, each display pixel 902 of a display apparatus 900 is constituted by an electron emission light-emitting device, such that a plurality of display pixels 902 forms a display frame, for displaying the static or dynamic picture. The electron emission light-emitting devices are used as the display pixels 902, so the electron emission light-emitting devices, for example, adopt fluorescent layers capable of emitting red, green, and blue lights to form red display pixels R, green display pixels G, and blue display pixels B, thereby achieving a full color display effect. In addition, as shown in FIG. 8, the red, green, and blue pixel arrays of another display apparatus 900' may be arranged depending on practical designs, so as to achieve a color gray-level display. Also, according to the design requirements, a pixel of another color light, for example, orange (O) light may be further added to form a pixel unit structure together with the red, green, and blue pixels.

Figure 9:
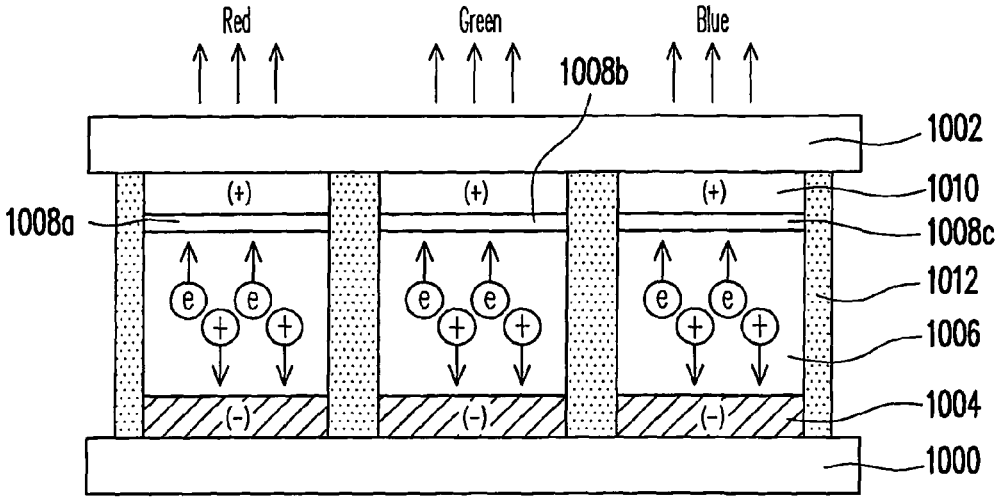
FIGS. 9 and 10 schematically show pixel structures of the display apparatus according to embodiments of the present invention.

FIG. 9 shows a pixel structure of a display apparatus according to an embodiment of the present invention. Referring to FIG. 9, generally speaking, a color is achieved by three primary colors, i.e., red, green, and blue, according to corresponding brightness gray-levels. In this embodiment, three pixels corresponding to red, green, and blue pixels are taken as an example for illustration.

The pixel structure designed by the above mentioned technology may include, for example, a first substrate 1000 and a second substrate 1002. A plurality of cathode structure layers 1004 is disposed on the first substrate 1000. The second substrate 1002 is made of a light-transmissive material. A plurality of anode structure layers 1010 is disposed on the second substrate 1000, in which the anode structure 1010 is made of a light-transmissive conductive material. The first substrate 1000 faces to the second substrate 1002, such that cathode structure layers 1004 are respectively aligned with the anode structure layers 1010. A separation structure 1012 is disposed between the first substrate 1000 and the second substrate 1002, for respectively partitioning the anode structure layers 1010 and the cathode structure layers 1004 to form a plurality of spaces. A plurality of fluorescent layers 1008*a*, 1008*b*, 1008*c* are respectively located between the anode structure layers 1010 and the cathode structure layers 1004. A low-pressure gas 1006 is filled in the spaces. The low-pressure gas 1006 has an electron mean free path, allowing at least sufficient amount of electrons to directly impinge the fluorescent layers 1008*a*, 1008*b*, 1008*c* under an operation voltage.

Herein, the fluorescent layer 1008*a*, the fluorescent layer 1008*b*, and the fluorescent layer 1008*c* are, for example, respectively made of different materials, and are excited to emit red, green, and blue lights. The gas pressure values of gas of the pixels may be identical or different from one another, which vary depending on the design and practical operation. Definitely, if the display is only required to display a single color, the material of the fluorescent layer may have a different arrangement.

Figure 10:
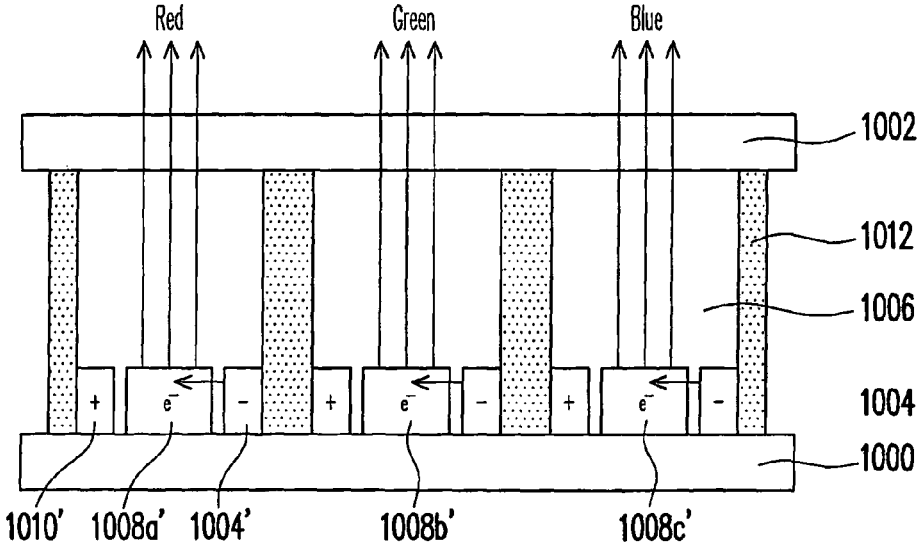

FIG. 10 shows a pixel structure of a display apparatus according to another embodiment of the present invention. Referring to FIG. 10, the display apparatus design is achieved by the structure of FIG. 9 depending on the design principle of FIG. 6, but is not limited to this. In the display apparatus of FIG. 9, the two electrode structures 1004, 1010 are respectively disposed on a lower substrate 1000 and an upper substrate 1002. In FIG. 10, two electrode structures 1004', 1010' and fluorescent layers 1008*a*', 1008*b*', 1008*c*' formed between the electrodes are disposed on the same side, for example, on the substrate 1000. For example, the substrate 1000 has a light reflecting function. Visible lights of different colors may be emitted based on the selection of the fluorescent materials, so as to generate desired mixed color.

Figure 11:
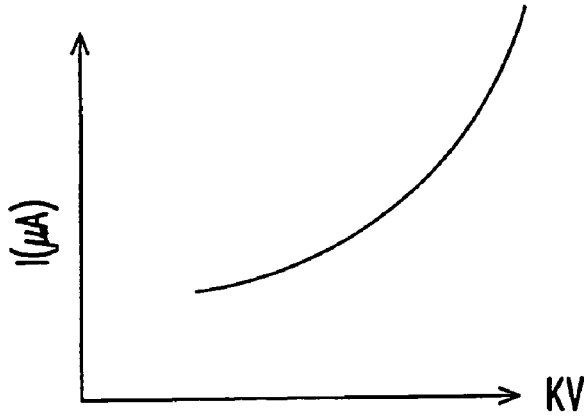
FIGS. 11 and 12 schematically show a luminance gray-level control mechanism according to an embodiment of the present invention.
Figure 12:
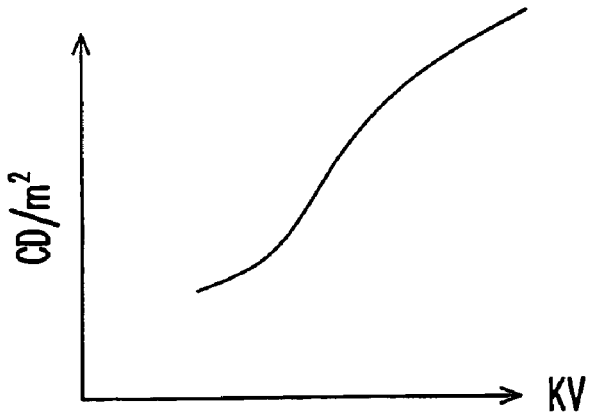

Images are displayed by the variations of the luminance gray-level, and the required color is determined by relative luminance gray-levels of red, green, and blue lights. Therefore, the gray-level of each pixel needs to be adjusted by some mechanisms. FIGS. 11 and 12 show a luminance gray-level control mechanism according to an embodiment of the present invention. Referring to FIG. 11, different reactive currents are generated according to different gas pressures and applied voltages. Generally speaking, as for a gas pressure of $2\times10^{-2}$ torr, the current and the applied voltage are substantially in a linear relationship. In addition, a turn on voltage also varies according to different gas pressures. Further, referring to FIG. 12, the magnitude of the applied voltage indicates the amount of electrons impinging the fluorescent layer and the bombard energy. The luminance in a unit area is also in a linear relationship with the applied voltage, and the gray-level value may be changed by changing the applied voltage, so as to obtain desired color.

Based on the reaction of the gas, under the selected gas pressure value, the relationship between the practically applied voltage and the gray-level may be obtained to serve as the data for calibrating the gray-level.

Figure 13:
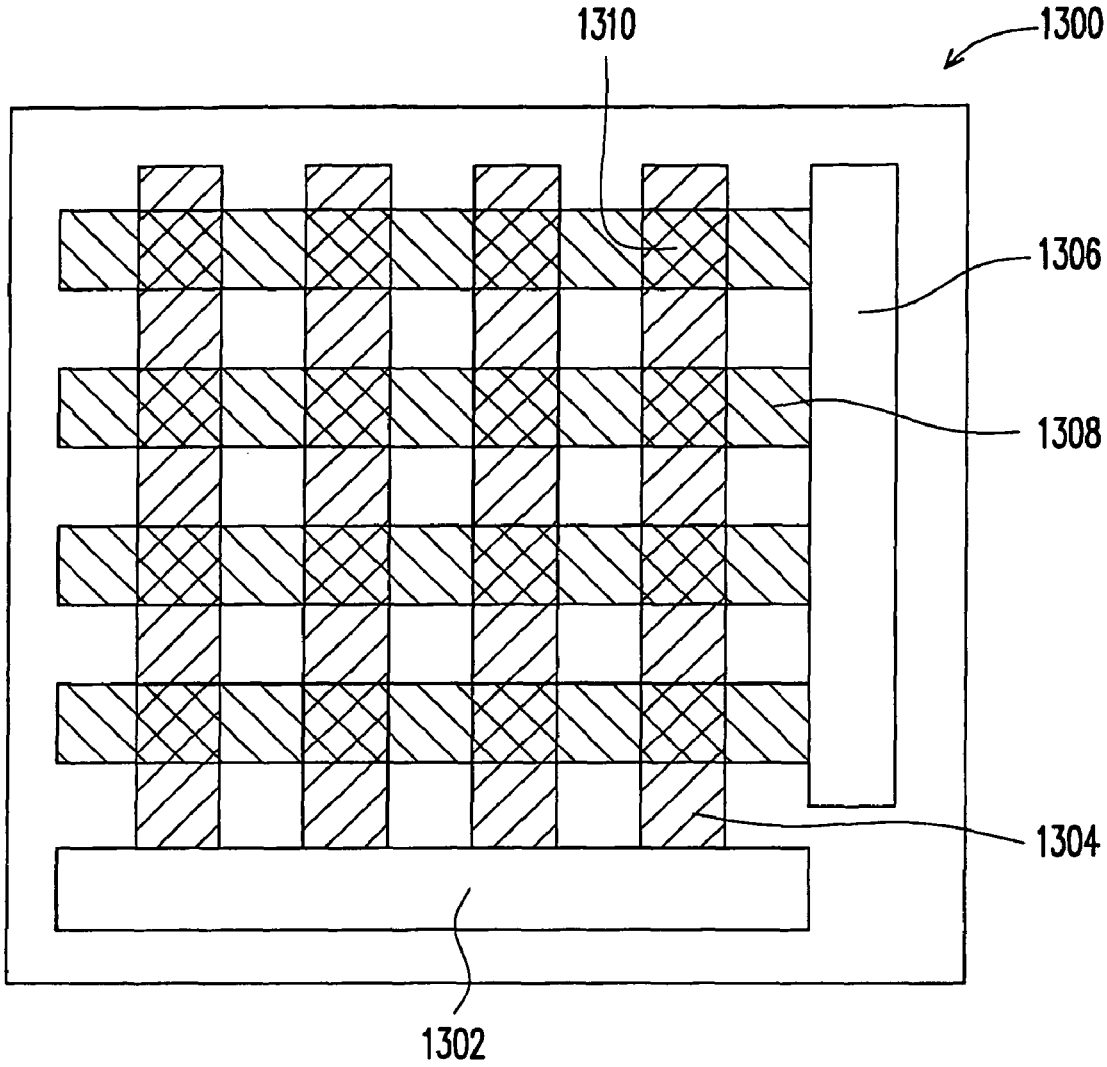
FIGS. 13 to 14 schematically show a display apparatus according to an embodiment of the present invention.

For example, the three pixels, i.e., red, green, and blue pixels of FIG. 9 or FIG. 10 are taken as a pixel unit, and the voltages corresponding to the gray-level may be driven by a driver. Referring to FIG. 13, a display apparatus 1300 based on a two-dimensional array driving mode includes a plurality of drivers 1302, 1306 on corresponding substrates, for respectively controlling the anode structures and the cathode structures of the pixels in two directions. The driver 1302 has a plurality of control circuits 1304 coupled to, for example, the anodes (or cathodes) of a plurality of pixels of a corresponding column, and the driver 1306 has a plurality of control circuits 1308 coupled to, for example, the cathodes (or anodes) of a plurality of pixels of a corresponding row. An intersected pixel 1310 is selected by the control circuit 1304 and the control circuit 1308, so as to apply a voltage corresponding to the greyscale value.

As for a passive driving mechanism, for example, a time division mechanism, scan lines are displayed sequentially in a frame unit of the scan lines. As human eyes have visual persistence, the image may be formed by displaying all the scan lines in sequence in a certain time. Herein, a time difference still exists between the first scan line and the last scan line, so in order to adjust the brightness difference, the brightness of first scan line is set to be higher and the brightness of the rest scan lines descends sequentially.

Figure 14:
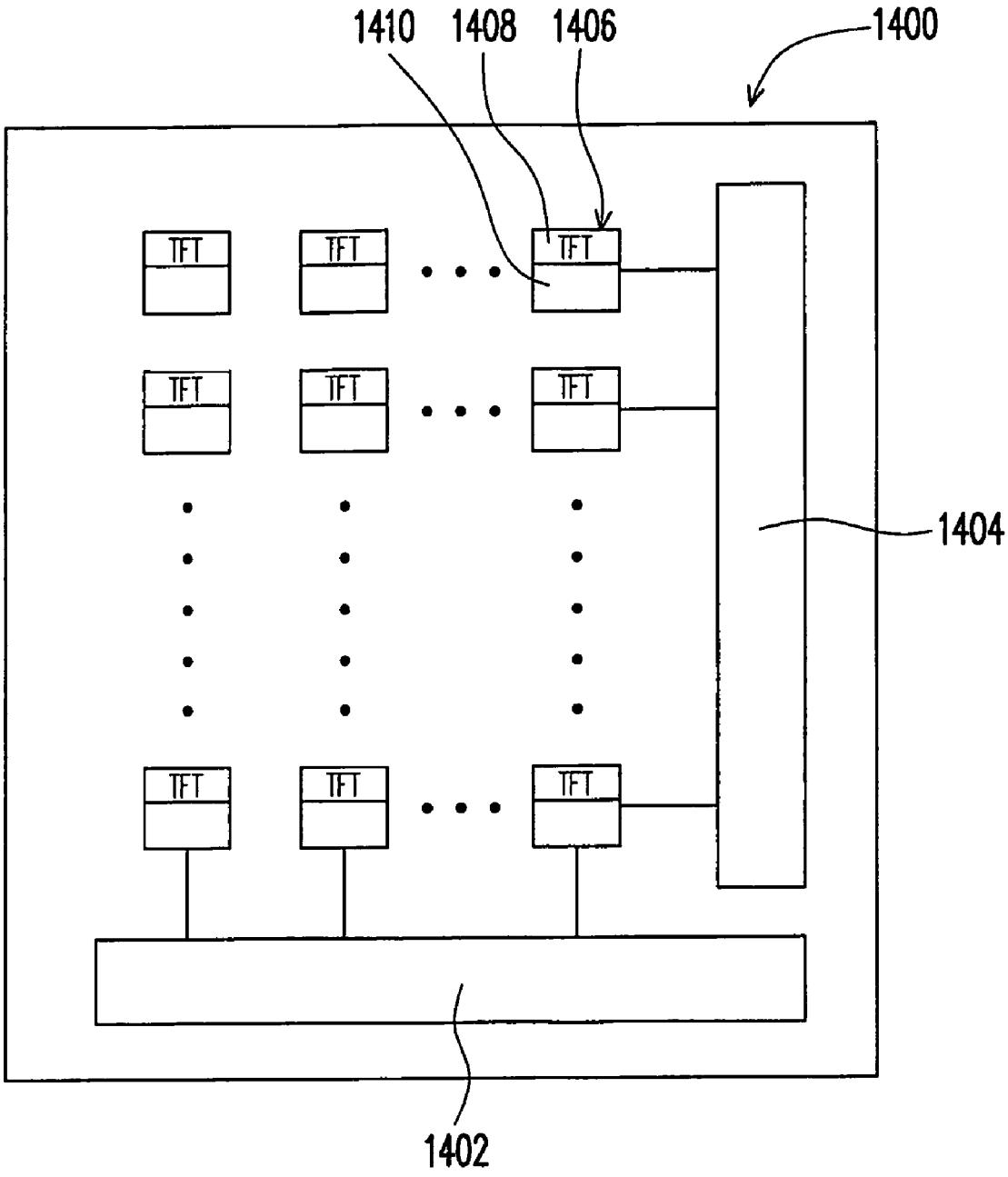

The above driving mechanism is driven in a passive mode. In addition, the driving mechanism may also be driven in an active mode. Referring to FIG. 14, a display apparatus 1400 based on a two-dimensional array driving mode includes a plurality of drivers 1402, 1404 disposed on corresponding substrates, for respectively controlling the anode structures and the cathode structures of the pixels in two directions. The driver 1402 has a plurality of control circuits coupled to, for example, the anodes (or cathodes) of a plurality of pixels of a corresponding column, and the driver 1404 has a plurality of control circuits coupled to, for example, the cathodes (or anodes) of a plurality of pixels of a corresponding row. An intersected pixel is selected by the control circuits, so as to apply a voltage corresponding to the gray-level. Different from the passive driving mechanism, in addition to a light-emitting unit 1410, each pixel 1406 further includes a switch control unit 1408. The switch control unit 1408 includes, for example, a thin film transistor (TFT) unit, which is controlled by the driver to turn on/off the pixel and control the light emitting brightness.

The details of the above driving mechanism are known to those of ordinary skill in the art, and details of the practical designs adopting the pixel structure and light emitting mechanism of the present invention will not be described herein.

In addition, the above embodiments may be combined to form different applications and variations depending on practical design requirements.

In view of the above, the electron emission light-emitting device provided by the present invention and the light source apparatus and display apparatus using the device have characteristics of power-saving, high light-emitting efficiency, short response time, easy to fabricate, and environmental-friendly (mercury free), thus providing another option of the light source apparatus and display apparatus on the market. As compared with the conventional light-emitting structure, the electron emission light-emitting device provided by the present invention has a simple structure, in which the cathode as long as being a planar structure can operate normally, and the related secondary electron source material layer or induced discharge structure is optional and not essential devices. Further, the electron emission light-emitting device of the present invention does not need the ultra high vacuum packaging, thus simplifying the production process and facilitating the mass production.

On the other hand, the cathode of the electron emission light-emitting device of the present invention may be a metal, so the reflectivity is improved and the brightness and light-emitting efficiency are also improved. Moreover, the wavelengths of the lights emitted by the electron emission light-emitting device vary depending on the types of the fluorescent layers, and the light sources of different wavelength ranges may be designed depending to different usages of the light source apparatus or the display apparatus. In addition, the electron emission light-emitting device of the present invention may be designed into a planar light source, a linear light source, or a spot light source, so as to meet different usage requirements of the display apparatus and the light source apparatus (e.g., backlight modules or illumination lamps).

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display pixel structure, comprising:

a first substrate;

a plurality of cathode structure layers, disposed on the first substrate;

a second substrate, made of a light-transmissive material;

a plurality of anode structure layers, disposed on the second substrate, wherein the anode structure layers are made of a light-transmissive conductive material, and the first substrate faces to the second substrate, such that the cathode structure layers are respectively aligned with the anode structure layers;

a separation structure, disposed between the first substrate and the second substrate, for respectively partitioning the anode structure layers and the cathode structure layers to form a plurality of spaces;

a plurality of fluorescent layers, respectively disposed between the anode structure layers and the cathode structure layers to form a plurality of pixels; and a low-pressure gas, filled in the spaces, wherein a gas pressure of the low-pressure gas is between $8\times10^{-1}$ torr and $10^{-3}$ torr.

wherein the low-pressure gas layer comprises an electron mean free path, allowing at least sufficient amount of electrons to directly impinge the fluorescent layers under an operation voltage, wherein the electron mean free path is at least 5 mm.

2. The display pixel structure according to claim 1, wherein the fluorescent layers are respectively disposed on a surface of the anode.

3. The display pixel structure according to claim 1, wherein the fluorescent layers emit lights of different colors according to material properties.

4. The display pixel structure according to claim 1, wherein at least three adjacent pixels form a pixel unit, and the three fluorescent layers comprise three fluorescent materials respectively emitting red, green, and blue lights.

5. The display pixel structure according to claim 4, wherein the pixel unit further comprises another primary color light.

6. The display pixel structure according to claim 1, wherein the operation voltage is applied corresponding to the anode structure layers and the cathode structure layers of the pixels, so as to generate desired luminance gray-level.

7. The display pixel structure according to claim 1, further comprising a plurality of secondary electron source material layers respectively disposed on the cathode structure layers.

8. The display pixel structure according to claim 7, wherein a material of the secondary electron source material layers comprises MgO, $Tb_2O_3$, $La_2O_3$, or $CeO_2$.

9. The display pixel structure according to claim 1, further comprising a plurality of induced discharge structures disposed on at least one of the anode structure layer and the cathode structure layer.

10. A display apparatus, comprising a plurality of display pixels arranged in an array, wherein each of the display pixels comprises an electron emission light-emitting device, and the electron emission light-emitting device comprises:

a cathode structure layer;

an anode structure layer;

a fluorescent layer, disposed between the cathode structure layer and the anode structure layer; and a low-pressure gas, disposed between the cathode and the anode, for inducing the cathode to emit a plurality of electrons, wherein the low-pressure gas comprises an electron mean free path, allowing at least sufficient amount of electrons to directly impinge the fluorescent layer under an operation voltage, wherein a gas pressure of the low-pressure gas is between $8\times10^{-1}$ torr and $10^{-3}$ torr, and the electron mean free path is at least 5 mm.

11. The display apparatus according to claim 10, wherein the fluorescent layer of each electron emission light-emitting device is disposed on a surface of the anode structure layer.

12. The display apparatus according to claim 10, further comprising an upper substrate and a lower substrate, for carrying the anode structure layer and the cathode structure layer of each electron emission light-emitting device.

13. The display apparatus according to claim 10, wherein each electron emission light-emitting device further comprises an induced discharge structure disposed on at least one of the anode structure layer and the cathode structure layer.

14. The display apparatus according to claim 10, wherein each electron emission light-emitting device further comprises a secondary electron source material layer disposed on the cathode.

15. The display apparatus according to claim 10, wherein three adjacent electron emission light-emitting devices form a pixel unit, for respectively emitting red, green, and blue lights.

16. The display apparatus according to claim 15, wherein the pixel unit further comprises another primary color light.

17. A display apparatus, comprising:

a first substrate;

a plurality of cathode structure layers, disposed on the first substrate to form a two-dimensional array;

a second substrate, made of a light-transmissive material;

a plurality of anode structure layers, disposed on the second substrate, wherein the anode structure layers are made of a light-transmissive conductive material, and the first substrate faces to the second substrate, such that the cathode structure layers are aligned with the anode structure layers;

a separation structure, disposed between the first substrate and the second substrate, for respectively partitioning the anode structure layers and the cathode structure layers to form a plurality of spaces;

a plurality of fluorescent layers, respectively disposed between the anode structure layers and the cathode structure layers to from a plurality of pixels;

a low-pressure gas, filled in the spaces, wherein the low-pressure gas layer comprises an electron mean free path, allowing at least sufficient amount of electrons to directly impinge the fluorescent layers under an operation voltage, wherein a gas pressure of the low-pressure gas is between $8\times10^{-1}$ torr and $10^{-3}$ torr and the electron mean free path is at least 5 mm; and a plurality of drive units, disposed on at least one of the first substrate and the second substrate, for controlling the pixels of the two-dimensional array, so as to apply the corresponding operation voltage to generate luminance gray-level.

18. The display apparatus according to claim 17, wherein the drive units drive the pixels in an active mode or a passive mode.

19. The display apparatus according to claim 17, wherein each pixel further comprises at least one thin film transistor (TFT) for assisting driving the pixels under the control of the drive units.

20. The display apparatus according to claim 17, wherein the fluorescent layers emit lights of different colors according to material properties.

21. The display apparatus according to claim 17, wherein the fluorescent layers emit different luminance gray-levels according to different operation voltages.

22. A display pixel structure, comprising:

a first substrate;

a second substrate, made of a light-transmissive material;

a separation structure, disposed between the first substrate and the second substrate for partitioning a plurality of spaces;

a plurality of cathode structure layers, disposed directly on the first substrate, wherein each of the spaces comprises one cathode structure layer;

a plurality of anode structure layers, disposed directly on the first substrate, wherein each of the spaces comprises one anode structure layer;

a plurality of fluorescent layers, disposed directly on the first substrate, respectively between the anode structure layers and the cathode structure layers to form a plurality of pixels; and a low-pressure gas, filled in the spaces, wherein the low-pressure gas layer comprises an electron mean free path, allowing at least sufficient amount of electrons to directly impinge the fluorescent layers under an operation voltage, wherein a gas pressure of the low-pressure gas is between $8\times10^{-1}$ torr and $10^{-3}$ torr.

23. The display pixel structure according to claim 22, wherein the electron mean free path is at least 5 mm.

24. The display pixel structure according to claim 22, wherein at least three adjacent pixels form a pixel unit, and the three fluorescent layers comprise three fluorescent materials respectively emitting red, green and blue lights.

25. The display pixel structure according to claim 24, wherein the pixel unit further comprises another primary color light.

26. The display pixel structure according to claim 22, wherein the operation voltage is applied corresponding to the anode structure layers and the cathode structure layers of the pixels, so as to respectively generate desired luminance gray-level.

27. The display pixel structure according to claim 22, further comprising a plurality of secondary electron source material layers respectively disposed on the cathode structure layers.

28. The display pixel structure according to claim 27, wherein a material of the secondary electron source material layers comprises MgO, $Tb_2O_3$, $La_2O_3$, or $CeO_2$.

29. The display pixel structure according to claim 22, further comprising a plurality of induced discharge structures disposed on at least one of the anode structure layer and the cathode structure layer.

30. A display apparatus, comprising:

a first substrate;

a second substrate, made of a light-transmissive material;

a separation structure, disposed between the first substrate and the second substrate, for partitioning a plurality of spaces to form a two-dimensional array;

a plurality of cathode structure layers, disposed directly on the first substrate, wherein each of the spaces comprises one cathode structure layer;

a plurality of anode structure layers, disposed directly on the first substrate, wherein each of the spaces comprises one anode structure layer;

a plurality of fluorescent layers, disposed directly on the first substrate, respectively disposed between the anode structure layers and the cathode structure layers to form a plurality of pixels; and a low-pressure gas, filled in the spaces, wherein the low-pressure gas layer comprises an electron mean free path, allowing at least sufficient amount of electrons to directly impinge the fluorescent layers under an operation voltage, wherein a gas pressure of the low-pressure gas is between $8\times10^{-1}$ torr and $10^{-3}$ torr and the electron mean free path is at least 5 mm; and a plurality of drive units, disposed on at least one of the first substrate and the second substrate, for controlling the pixels of the two-dimensional array, so as to apply the corresponding operation voltage to generate luminance gray-level.

31. The display apparatus according to claim 20, wherein at least three adjacent pixels form a pixel unit, and the three fluorescent layers comprises three fluorescent materials respectively emitting red, green, and blue lights.

32. The display apparatus according to claim 30, wherein the pixel unit further comprises another primary color light.

33. The display apparatus according to claim 30, wherein the operation voltage is applied corresponding to the anode structure layers and the cathode structure layers of the pixels, so as to respectively generate desired luminance gray-level.

34. The display apparatus according to claim 30, further comprising a plurality of secondary electron source material layers respectively disposed on the cathode structure layers.

35. The display apparatus according to claim 34, wherein a material of the secondary electron source material layers comprises MgO, $Tb_2O_3$, $La_2O_3$, or $CeO_2$.

36. The display apparatus according to claim 30, further comprising a plurality of induced discharge structures disposed on at least one of the anode structure layer and the cathode structure layer.

* * * * *